US007492353B2

(12) United States Patent
Ushimaru et al.

(10) Patent No.: US 7,492,353 B2
(45) Date of Patent: Feb. 17, 2009

(54) JOYSTICK SWITCHING DEVICE

(75) Inventors: Hiroshi Ushimaru, Miyagi-ken (JP); Yukiharu Hayashi, Miyagi-ken (JP); Takuya Maeda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 870 days.

(21) Appl. No.: 10/963,096

(22) Filed: Oct. 12, 2004

(65) Prior Publication Data

US 2005/0077156 A1 Apr. 14, 2005

(30) Foreign Application Priority Data

Oct. 14, 2003 (JP) ..... 2003-353897

(51) Int. Cl.
*G09G 5/08* (2006.01)
*H01H 19/00* (2006.01)

(52) U.S. Cl. ..... 345/161; 200/6 A

(58) Field of Classification Search ..... 345/156–167; 200/6 A; 341/20
See application file for complete search history.

(56) References Cited

U.S. PATENT DOCUMENTS 4,747,313 A * 5/1988 Okada ..... 73/862.043
5,543,592 A * 8/1996 Gaultier et al. ..... 345/161
5,589,828 A * 12/1996 Armstrong ..... 345/161
5,926,167 A * 7/1999 Niitsuma et al. ..... 345/156
6,307,486 B1 * 10/2001 Takeda et al. ..... 345/161
2002/0024503 A1 * 2/2002 Armstrong ..... 345/167
2002/0054015 A1 * 5/2002 Wingett et al. ..... 345/156
2002/0080116 A1 * 6/2002 Onodera et al. ..... 345/161
2002/0190948 A1 * 12/2002 Coutant et al. ..... 345/161

FOREIGN PATENT DOCUMENTS

JP 7-30431 6/1995

* cited by examiner

*Primary Examiner*—Amr Awad
*Assistant Examiner*—Waseem Moorad
(74) *Attorney, Agent, or Firm*—Brinks Hofer Gilson & Lione

(57) ABSTRACT

A fixed shaft mounted to a lower casing holds a tiltable component used for operating tilt-detecting switches. At the upper portion of the tiltable component, a tilt-operation feel providing member including a first slider unit being slidable by the tiltable component, driving bars in contact with the first slider unit, and springs urging the driving bars toward the first slider unit is arranged. First operational-feel providing portions arranged like flowers are formed on the bottom of the first slider unit. When the tiltable component is tilted, the first slider unit is slid. The driving bars are then moved on recesses constituting the first operational-feel providing portions.

5 Claims, 6 Drawing Sheets

JOYSTICK SWITCHING DEVICE

This application claims the benefit of priority to Japanese Patent Application No. 2003-353897 filed on Oct. 14, 2003, herein incorporated by reference.

BACKGROUND OF THE INVENTION

1. Field of the Invention

The present invention relates to joystick switching devices used as controllers for automotive electrical systems or the like. In particular, the present invention relates to means for providing a required operational feel to a user through an operation knob.

2. Description of the Related Art

As a controller of an automotive audio system, an automotive air conditioner, or the like, a joystick switching device has been known that has an operation component serving as a tilt-operation knob and a button, a turning knob, a switch that can be switched by operating the operation component, and a switch that can be switched by operating the turning knob.

FIG. 8 is a cross-sectional view of one such known joystick switching device. This joystick switching device includes: a casing 101 including an upper casing unit 101*a* and a lower casing unit 101*b*; a wiring board 102 held in the casing 101; a flexible sheet 103 attached to the wiring board 102 and having dome portions 103*a*; tilt-operation sheet switches 104, a push-button sheet switch 105, and rotating-operation sheet switches 106, each having a fixed contact (not shown) formed on the surface of the wiring board 102 and a conductive material body (not shown) formed on the top of each of the dome portions 103*a*; an X-Y operating unit 107 supported by the upper casing unit 101*a* so as to be freely tiltable and arranged such that the lower edge of the X-Y operating unit 107 is opposed to the tilt-operation sheet switches 104; a shaft 108 for a tilt operation and a slide operation supported by the X-Y operating unit 107 so as to be freely slidable and arranged such that the lower edge of the shaft 108 is opposed to the push-button sheet switch 105; an operation component 109 serving as both a tilt-operation knob and a button and being integrated with the upper edge of the shaft 108; a spring 110 stretched between the upper casing unit 101*a* and the shaft 108; a turning knob 111 supported by the upper casing unit 101*a* so as to be freely turnable; and a turn-operation unit 112 connected to the turning knob 111 and opposed to the rotating-operation sheet switches 106 (see, for example, Japanese Unexamined Utility Model Registration Application Publication No. 7-30431).

In this known joystick switching device, when a force is applied on the shaft 108 laterally, the shaft 108 and the X-Y operating unit 107 are tilted in the direction of the force while resisting an elastic force of the spring 110. In accordance with the direction of the force, a required dome portion 103*a* is then selectively compressed by the end of the X-Y operating unit 107, and at least one or two of the tilt-operation sheet switches 104 are selectively switched to conduction. When a force is applied on the shaft 108 in the axial direction, the shaft 108 is slid in the X-Y operating unit 107 while resisting an elastic force of the spring 110. Another dome portion 103*a* is then compressed by the end of the shaft 108, and the push-button sheet switch 105 is selectively switched to conduction. When a force is applied on the turning knob 111 in a direction of rotation, the turning knob 111 and the turn-operation unit 112 are turned in the direction of the force. An operational element 112*a* of the turn-operation unit 112 comes into contact with a side of a required dome portion 103*a*, and therefore, the desired dome portion 103*a* is tilted, so that the rotating-operation sheet switches 106 are selectively switched to conduction.

As a result, systems can be controlled by the use of contact signals supplied from one or two tilt-operation sheet switches 104, from the push-button sheet switch 105, and from the rotating-operation sheet switches 106.

When this type of a joystick switching device is used as a controller for an automotive electrical system, a driver must operate the tilt-operation knob 109 or the turning knob 111 without having to stop looking ahead while driving the car. To avoid an operating error and facilitate various controls, it is highly necessary to have good operational feel of the tilt-operation knob 109 and the turning knob 111.

However, since the flexible sheet 103 functioning as means for providing an operational feel is positioned near the leading edge of the shaft 108, the distance between the tilt-operation knob 109 and the dome portion 103*a* is inevitably long. As a result, the elastic deformation of the shaft 108 and the X-Y operating unit 107 prevents tactile feedback occurring when the dome portion 103*a* is compressed or tilted from being provided to the tilt-operation knob 109. There are problems in that it is hard to provide the user with a sharp operational feel.

SUMMARY OF THE INVENTION

The present invention is achieved to solve the above problems. It is an object of the present invention to provide a joystick switching device capable of providing a good operational feel to a user through a tilt-operation knob, which is operated by the hand of the user.

According to the present invention, a joystick switching device includes a casing, tilt-detecting means disposed in the casing, a tiltable component having a tilt shaft capable of being subjected to a tilt operation and a driving leg for driving the tilt shaft and the tilt-detecting means, the tiltable component being held on the casing, and the driving leg being joined to the tilt shaft, a tilt-operation knob that cooperates with the tilt shaft, and tilt-operation feel providing means for providing a required operational feel to a user in response to a tilt operation of the tilt shaft. The tilt-operation feel providing means is arranged around the tilt shaft so as to cooperate with the tilt shaft of the tiltable component.

As described above, the tilt-operation feel providing means for providing an operational feel, such as tactile feedback, in response to a tilt operation of the tilt shaft is arranged around the tiltable component. As a result, the distance between the tilt-operation feel providing means and the tilt-operation knob is short, and therefore, the elastic deformation of the tiltable component has little effect. The tactile feedback supplied from the tilt-operation feel providing means is directly provided to the tilt-operation knob, thus achieving a good operational feel of the tilt-operation knob serving as both a tilt operation and a push operation in a tilt direction. Accordingly, this joystick switching device functioning as a controller of an automotive electrical system allows the user to perform various controls for the automotive electrical system readily and reliably without looking at the joystick switching device, and therefore, the operability of the joystick switching device is increased.

In the joystick switching device, the tilt-operation feel providing means may include a cylindrical tilt-shaft holder including a through-hole through which the tilt shaft passes and being fixed to the casing, a cylindrical slider holder including a through-hole through which the tilt shaft passes and being mounted on the tilt-shaft holder with a predetermined gap therebetween, a slider disposed in a space defined between-the top of the tilt-shaft holder and the top of the slider holder, the slider being slidable in accordance with a tilt operation of the tilt shaft inside the space, a first operational-feel providing portion formed on the bottom surface of the slider, a driving bar being movable reciprocally through the top of the tilt-shaft holder, the leading edge of the driving bar being in contact with the first operational-feel providing portion, and a first spring urging the driving bar toward the slider.

As described above, the tilt-operation feel providing means for providing an operational feel, such as tactile feedback, in response to a tilt operation of the tilt shaft includes the slider having the first operational-feel providing portion, the driving bar whose leading edge is in contact with the first operational-feel providing portion, and the first spring urging the driving bar toward the slider. As a result, a change in a state of contact between the first operational-feel providing portion and the driving bar, functioning as a mechanical operational feel, is provided to the tilt-operation knob. A sharp operational feel that is not realized by the elastic deformation of the flexible sheet is provided to a user, thus increasing the operability of the joystick switching device. Unlike the flexible sheet, the tilt-operation feel providing means is less prone to degradation with time, so that a good operational feel can last a long time.

In the joystick switching device, the slider may include a first slider unit having the first operational-feel providing portion formed in the bottom surface of the first slider unit and being slidable by the tilt shaft in a tilt direction of the tilt shaft and a second slider unit engaging with the first slider unit so as to be slidable in only one direction independently of a tilt direction of the tilt shaft.

As described above, the slider consists of a combination of the first slider unit being slidable by the tilt shaft and the second slider unit being slidable in only one direction independently of a tilt direction of the tilt shaft. As a result, the second slider unit prevents the first slider unit from being rotated by a turn of the tilt shaft, and therefore, the first operational-feel providing portion formed in the bottom surface of the first slider unit is moved in parallel in a tilt direction of the tilt shaft all the time. A required operational feel in accordance with a change in a state of contact between the first operational-feel providing portion and the driving bar can be provided to a user through the tilt-operation knob with stability.

The joystick switching device may further include a rotatable unit disposed around the tilt-operation feel providing means, a turning knob mounted on the upper end of the rotatable unit, turn-operation feel providing means for providing a required operational feel to a user in response to a turn operation of the turning knob, and rotation-detecting means for detecting a state of rotation of the rotatable unit.

As described above, the rotatable unit being turnable by the turning knob is arranged around the tilt-operation feel providing means. The rotatable unit receives a required operational feel from the turn-operation feel providing means, and the state of rotation of the rotatable unit can be detected by the rotation-detecting means. As a result, an automotive electrical system can be controlled based on both a switching signal output from tilt-detecting switches by the operation of the tilt-operation knob and a detection signal from the rotation-detecting means. Therefore, the joystick switching device can have enhanced performance.

In the joystick switching device, the turn-operation feel providing means may include a second operational-feel providing portion arranged circumferentially about the rotation center of the rotatable unit on the bottom surface of the rotatable unit, a ball being movable in the casing and being in contact with the second operational-feel providing portion, and a second spring urging the ball toward the rotatable unit.

As described above, the turn-operation feel providing means for providing an operational feel, such as tactile feedback, in response to a turn operation of the rotatable unit includes the second operational-feel providing portion formed on the bottom surface of the rotatable unit, the ball-in contact with the second operational-feel providing portion, and the second spring urging the ball toward the rotatable unit. As a result, a change in a state of contact between the second operational-feel providing portion and the ball, functioning as a mechanical operational feel, is provided to the turning knob. A sharp operational feel is thus provided to a user, so that the operability of the joystick switching device can be increased and a good operational feel can last a long time.

In the joystick switching device, the rotation-detecting means may include light-shielding plates arranged like the teeth of a comb and disposed circumferentially about the rotation center of the rotatable unit, a light-emitting element, and a photoreceptor element. The light-emitting element and the photoreceptor element may be arranged on opposite sides of a path for passing the light-shielding plate therebetween.

As described above, the detecting means for detecting a state of rotation of the rotatable unit includes the light-shielding plates formed on the rotatable unit, the light-emitting element, and the photoreceptor element, an optical path between both elements being interrupted by the light-shielding plate. Compared with when a magnetic sensing element or light-reflecting detecting means is used, the rotatable unit has a simpler structure. As a result, the joystick switching device is available at low cost.

In the joystick switching device according to the present invention, the tilt-operation feel providing means for providing an operational feel, such as tactile feedback, to a user in response to a tilt operation of the tiltable component is disposed near the tiltable component. The distance between the tilt-operation feel providing means and the tilt-operation knob is thus short, so that an operational feel supplied from the tilt-operation feel providing means is directly provided to the tilt-operation knob. A good operational feel of the tilt-operation knob in a tilt direction is realized. The joystick switching device according to the present invention functioning as a controller of an automotive electrical system allows the user to perform various controls for the automotive electrical system readily and reliably without looking at the joystick switching device, and therefore, the operability of the joystick switching device is increased.

DESCRIPTION OF THE PREFERRED EMBODIMENTS

Figure 1:
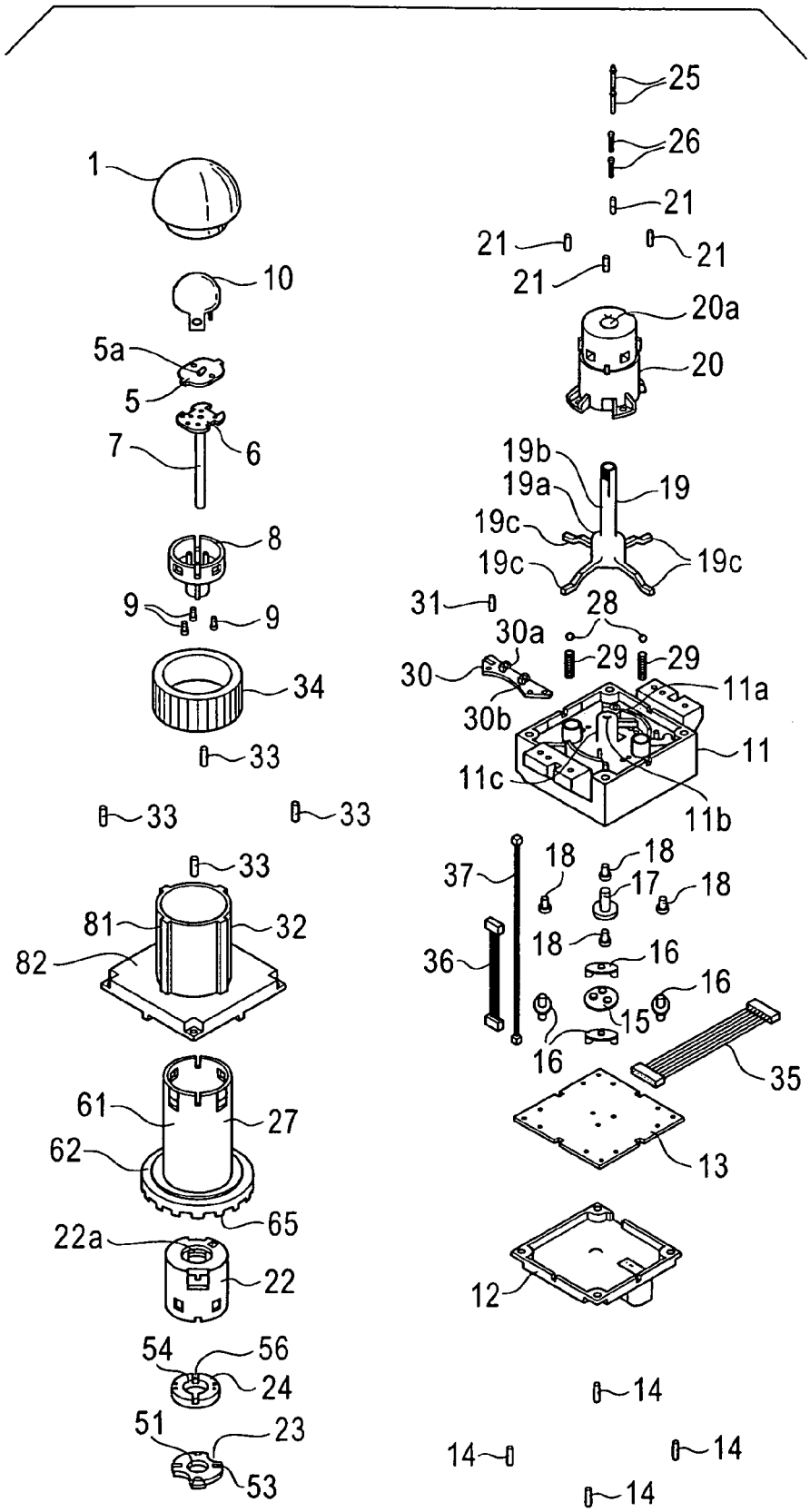
FIG. 1 is an exploded perspective view of a joystick switching device according to an embodiment of the present invention.
Figure 2:
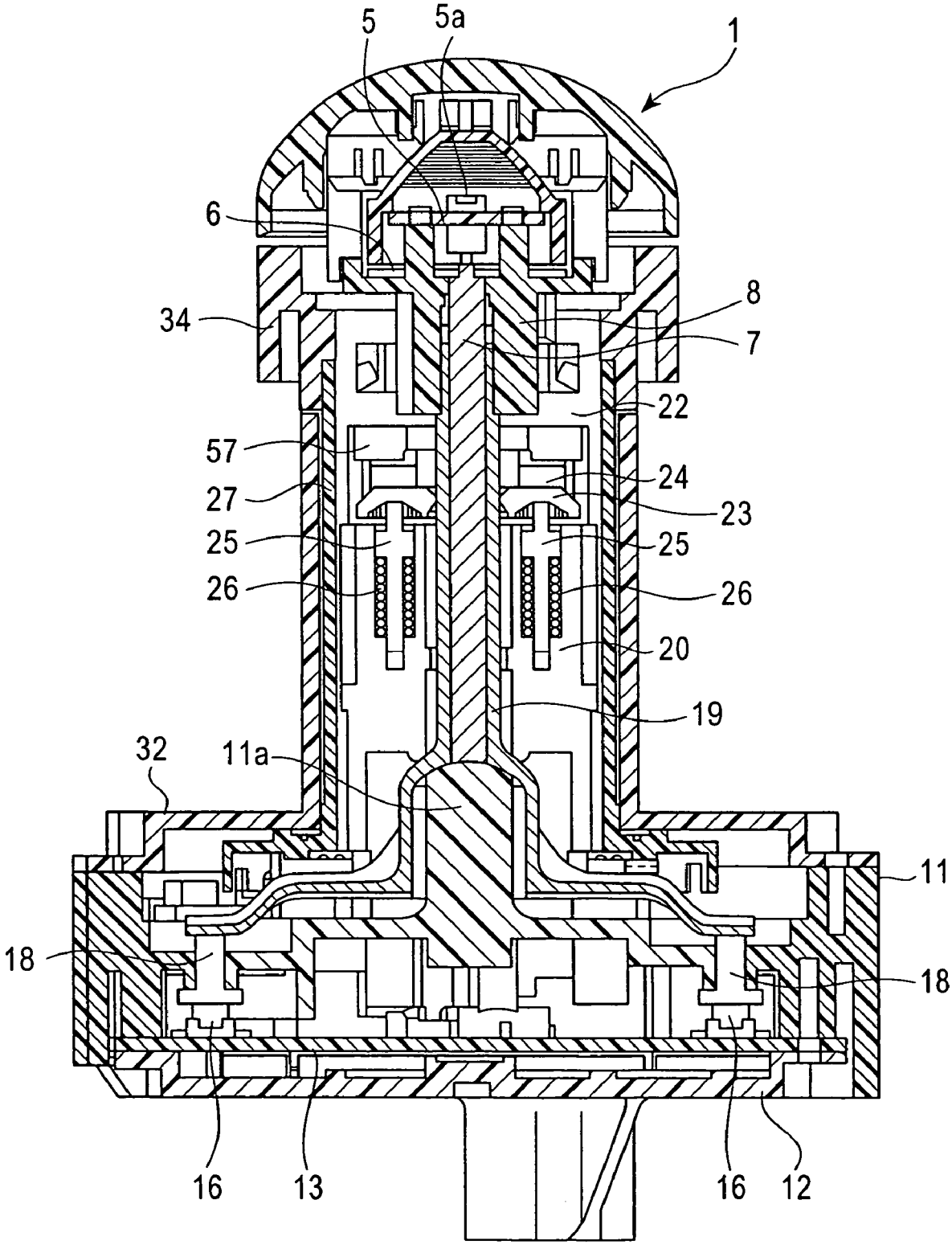
FIG. 2 is a cross-sectional view showing when the joystick switching device according to the embodiment is not operated.
Figure 3:
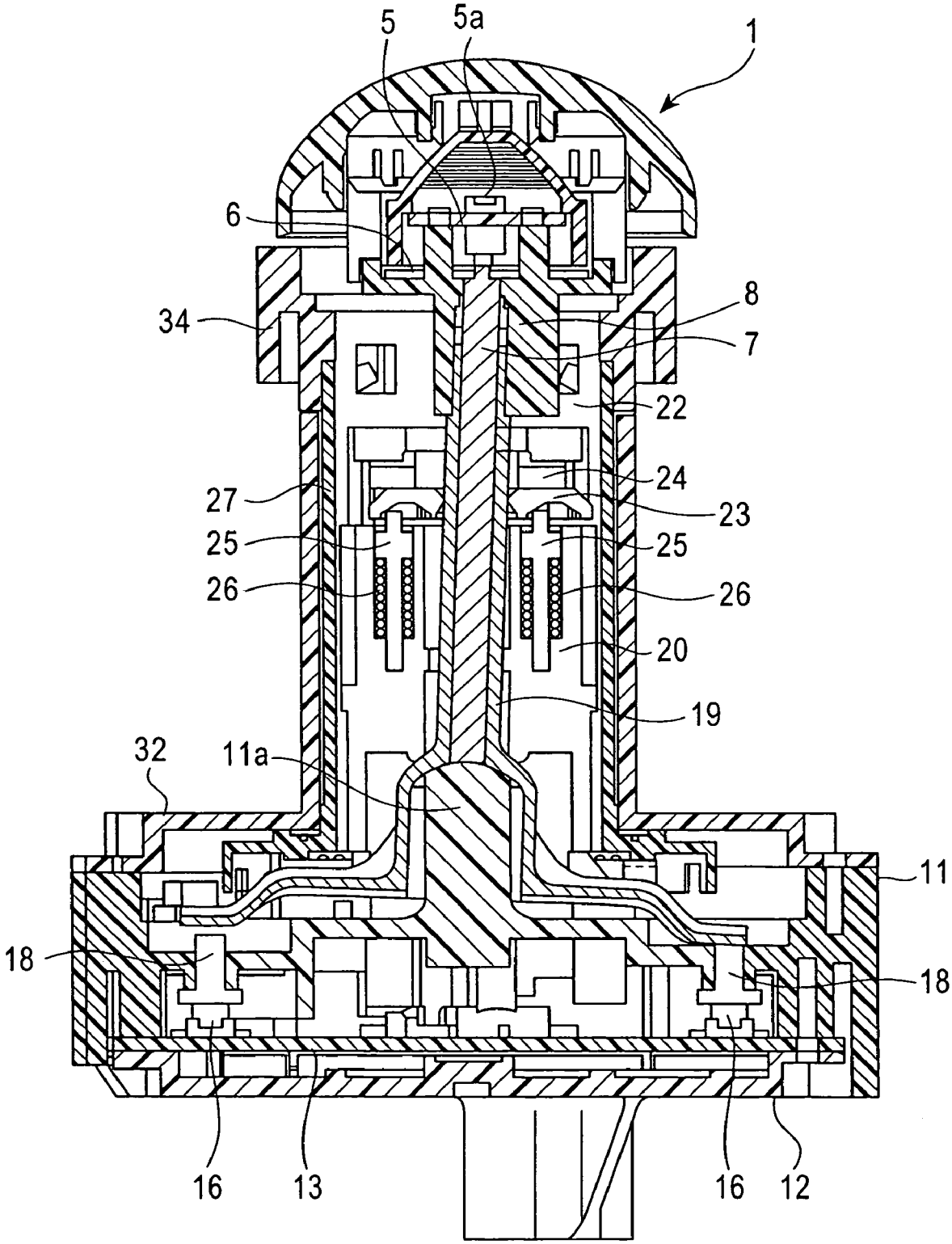
FIG. 3 is a cross-sectional view showing when the joystick switching device according to the embodiment is subjected to a tilt operation.
Figure 4:
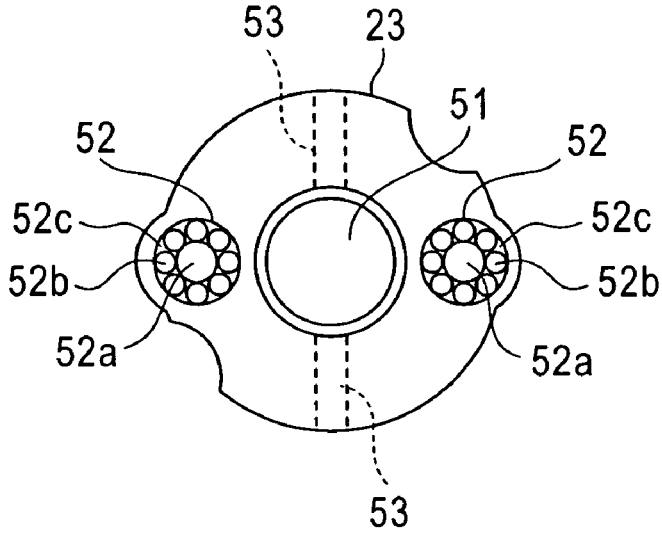
FIG. 4 is a bottom plan view of a first slider unit.
Figure 5:
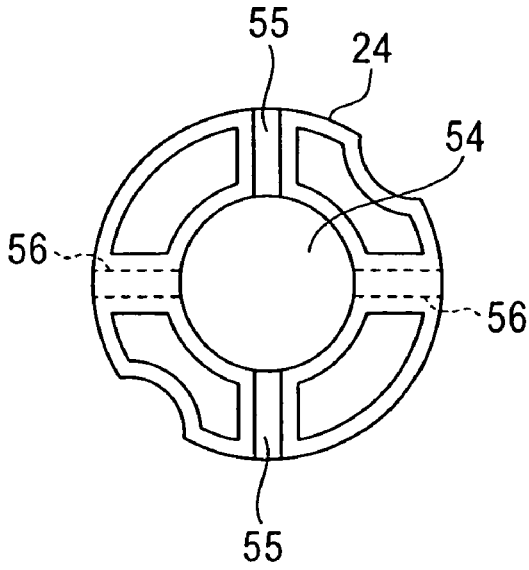
FIG. 5 is a bottom plan view of a second slider unit.
Figure 6:
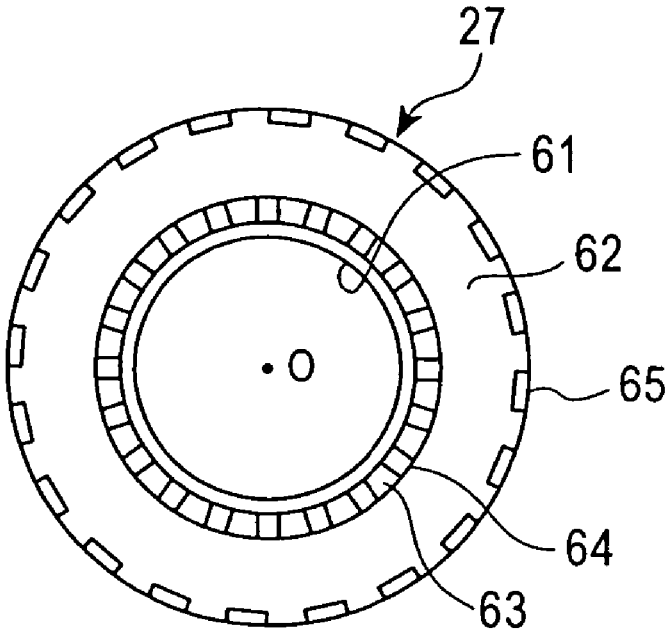
FIG. 6 is a bottom plan view of a rotatable unit.
Figure 7:
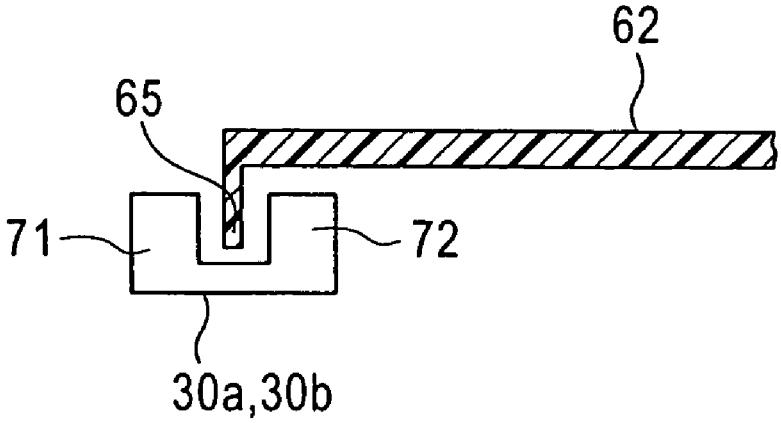
FIG. 7 is a cross-sectional view showing how photo-interrupters are arranged relative to a light-shielding plate.
Figure 8:
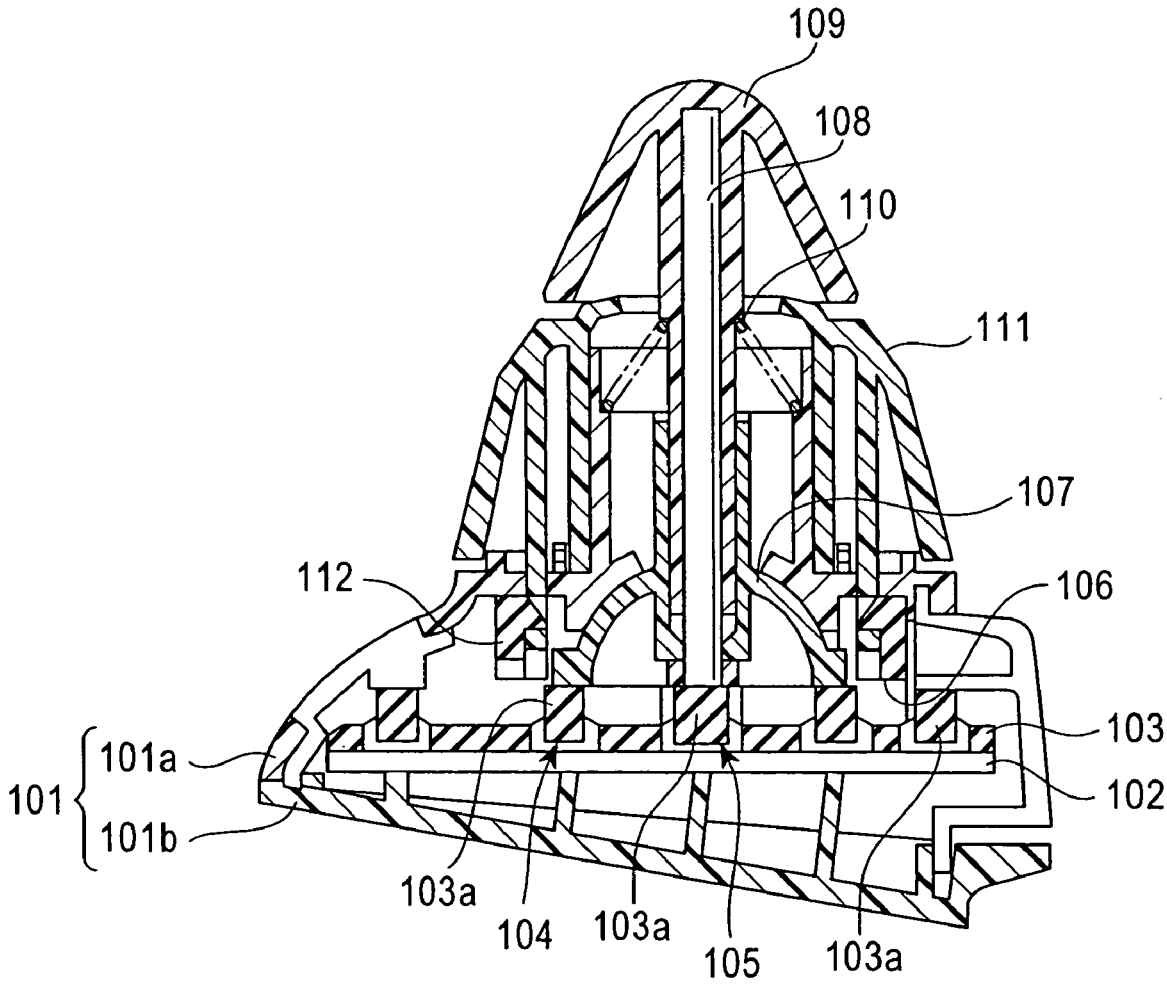
FIG. 8 PRIOR ART
FIG. 8 is a cross-sectional view of a known joystick switching device.

A preferred embodiment of the present invention will now be described with reference to FIGS. 1 to 7. FIG. 1 is an exploded perspective view of a joystick switching device according to this embodiment of the present invention. FIG. 2 is a cross-sectional view showing when the joystick switching device according to the embodiment is not operated. FIG. 3 is a cross-sectional view showing when the joystick switching device according to the embodiment is subjected to a tilt operation. FIG. 4 is a bottom plan view of a first slider unit. FIG. 5 is a bottom plan view of a second slider unit. FIG. 6 is a bottom plan view of a rotatable unit. FIG. 7 is a cross-sectional view showing how photo-interrupters are arranged relative to a light-shielding plate.

As shown in FIG. 1, the joystick switching device of this embodiment has: a tilt-operation knob 1; a first wiring board 5 having a light-emitting body 5*a*, such as a light-emitting diode; a stopping plate 6 holding the first wiring board 5; a first tilt shaft 7 suspended from the bottom of the stopping plate 6; a knob holder 8 holding the first wiring board 5, the stopping plate 6, and the first tilt shaft 7; screws 9 securing the stopping plate 6 to the knob holder 8; a light-emitting body cover 10 joined to the knob holder 8 by a snap fit and covering the periphery of the light-emitting body 5*a* mounted on the first wiring board 5; a lower casing 11 including a hollow fixed shaft 11*a*; a lower cover 12 attached to the bottom of the lower casing 11; a second wiring board 13 accommodated in a space defined between the lower casing 11 and the lower cover 12; screws 14 integrally securing the lower casing 11, the lower cover 12, and the second wiring board 13; four tilt-detecting-switch rubber contacts 16; four tilt-detecting-switch driving bars 18 whose bottoms are in contact with the tilt-detecting-switch rubber contacts 16; a tiltable component 19 including a hollow second tilt shaft 19*b* and supported on the top of the hollow fixed shaft 11*a*; a cylindrical tilt-shaft holder 20 including a through-hole 20*a* through which the second tilt shaft 19*b* passes and fixed to the lower casing 11; screws 21 securing the tilt-shaft holder 20 to the lower casing 11; a cylindrical slider holder 22 including a through-hole 22*a* through which the second tilt shaft 19*b* passes and mounted to the upper portion of the tilt-shaft holder 20 with a predetermined space therebetween; a first slider unit 23 and a second slider unit 24, both of which are arranged in a space defined between the top of the tilt-shaft holder 20 and the top of the slider holder 22; two driving bars 25 mounted on the tilt shaft holder 20 and being in contact with the bottom of the first slider unit 23; two first springs 26 urging the driving bars 25 toward the first slider unit 23; a cylindrical rotatable unit 27 disposed around the tilt-shaft holder 20 and the slider holder 22 so as to be freely turnable; two balls 28 mounted on the lower casing 11 and being in contact with the bottom of the rotatable unit 27; two second springs 29 urging the balls 28 toward the rotatable unit 27; a third wiring board 30 having two photo-interrupters 30*a* and 30*b*, both of which serve as detecting means, and disposed on the lower casing 11; a screw 31 securing the third wiring board 30 to the lower casing 11; an upper casing 32 through which the rotatable unit 27 passes, the upper casing 32 being attached to the top of the lower casing 11; screws 33 securing the upper casing 32 to the lower casing 11; a turning knob 34 joined to the top of the rotatable unit 27 by a snap fit; and a first harness 35, a second harness 36, and a third harness 37 for connecting the wiring boards.

The stopping plate 6, the first tilt shaft 7, the screws 9, 14, 21, 31, and 33, the tiltable component 19, the first springs 26, the second springs 29, and the balls 28 are formed from metal materials; other members are formed from insulating resin materials.

The tilt-operation knob 1 has a hemispherical single-piece structure and is joined to the periphery of the knob holder 8 by a snap fit.

The first wiring board 5 is joined to the stopping plate 6 by a snap fit, and the stopping plate 6 is secured to the knob holder 8 with the screws 9. The first tilt shaft 7 passes through a through hole formed in the knob holder 8 and projects below the knob holder 8.

The light-emitting body cover 10 is shaped like a dome and made of a transparent or translucent material so as to evenly illuminate the surface of the tilt-operation knob 1 with light from the light-emitting body 5*a*. This light-emitting body cover 10 is joined to the knob holder 8 by a snap fit.

On the surface of the second wiring board 13, fixed contacts for the tilt-detecting switches and necessary wiring, both of which are not shown, are formed in a predetermined arrangement. The tilt-detecting-switch rubber contacts 16 are opposed to these fixed contacts for the tilt-detecting switches. The inner faces of dome-shaped projections of the tilt-detecting-switch rubber contacts 16 have movable contacts for electrically connecting the fixed contacts formed on the surface of the second wiring board 13 so that a desired switching signal can be output by elastically deforming the dome-shaped-projections of the tilt-detecting-switch rubber contacts 16 and thereby electrically connecting the fixed contacts and the movable contacts. As shown in FIGS. 2 to 4, the tilt-detecting-switch rubber contacts 16 are circumferentially arranged about the axis of the fixed shaft 11*a* with equal spacing.

The four tilt-detecting-switch driving bars 18 are disposed on the lower casing 11 so as to be vertically movable. The bottoms of the tilt-detecting-switch driving bars 18 are in contact with the tops of the tilt-detecting-switch rubber contacts 16.

The tiltable component 19 includes a large-diameter portion 19*a* into which the fixed shaft 11*a* of the lower casing 11 is inserted, the small-diameter second tilt shaft 19*b* projecting upwardly from the top of the large-diameter portion 19*a*, and four driving legs 19*c* extending radially from the bottom of the large-diameter portion 19*a*. The inside diameter of the large-diameter portion 19*a* is such that the fixed shaft 11*a* of the lower casing 11 is inserted loosely, and the top end of the large-diameter portion 19*a* is spherical. The spherical top end of the fixed shaft 11*a* on the lower casing 11 is angularly smaller than an inner spherical face of the large-diameter portion 19*a* and has substantially the same diameter as the inner spherical face of the large-diameter portion 19*a*. As a result, as shown in FIGS. 2 to 4, the fixed shaft 11*a* is inserted into the large-diameter portion 19*a*, and both spherical faces are butted against each other. Therefore, the tiltable component 19 is supported by the fixed shaft 11*a* so as to be freely tiltable. As is evident from these drawings, the leading edges of the driving legs 19*c* are in contact with the top ends of the tilt-detecting-switch driving bars 18.

The tilt-shaft holder 20 is secured to the top surface of the lower casing 11 by the screws 21. The slider holder 22 is joined to the top of the tilt-shaft holder 20 by a snap fit. Therefore, a space for accommodating the first slider unit 23 and the second slider unit 24 is provided between the top of the tilt-shaft holder 20 and that of the slider holder 22.

The first slider unit 23 is used for providing a required operational feel in response to the tilt operation of the tiltable component 19 and the tilt-operation knob 1 by sliding in accordance with a tilt operation or a turn operation of the tiltable component 19 in the tilt direction or the turn direction and by cooperating with the driving bars 25 and the first springs 26 mounted on the tilt-shaft holder 20. The second slider unit 24 is used for preventing the first slider unit 23 from rotating around the second tilt shaft 19*b* when the tiltable component 19 is subjected to the tilt operation or the turn operation.

Specifically, the first slider unit 23 is annular and has a central hole 51. The central hole 51 can come into contact with the periphery of the second tilt shaft 19*b* when the first slider unit 23 slides. The first slider unit 23 is disposed around the second tilt shaft 19*b*. As indicated in FIG. 4, two first operational-feel providing portions 52, which are recessed portions, are symmetrically arranged on the bottom surface of the first slider unit 23 with the central through-hole 51 therebetween. Each of these first operational-feel providing portions 52 includes a substantially circular central recess 52*a*, eight outer recesses 52*b* arranged around the central recess 52*a* at equal spacing, and projections 52*c* formed in gaps among the central recess 52*a* and the outer recesses 52*b*. These recess members of the first operational-feel providing portion 52 are arranged like a flower. On the tilt-shaft holder 20, the driving bars 25 and the first springs 26 are arranged in positions opposed to the first operational-feel providing portions 52 at the same spacing as that between the two central recesses 52*a*. Accordingly, in a state in which the joystick switching device is not operated, as shown in FIG. 2, each of the leading edges of the driving bars 25 is in contact with each of the central recesses 52*a* so that the tiltable component 19 is held with stability. When the tiltable component 19 is tilted in one direction from this state, as shown in FIG. 3, or when the tiltable component 19 is subjected to a turn operation from a state in which the tiltable component 19 is tilted in one direction, the first slider unit 23 is then moved in a tilt direction or a turn direction of the tiltable component 19 and the driving bars 25 are moved on from the central recesses 52*a* to the outer recesses 52*b*. Therefore, movements occurring when the driving bars 25 pass over the projections 52*c* are conveyed to the tilt-operation knob 1 through the tiltable component 19, and thus, the user can have a required operational feel. As indicated by short dashed lines in FIG. 4, two ribs 53 engaging the second slider unit 24 are aligned on the top surface of the first slider unit 23 in a direction orthogonal to the direction where the first operational-feel providing portions 52 are arranged.

The second slider unit 24 is annular and has a central hole 54. The central hole 54 does not come into contact with the second tilt shaft 19*b* when the second slider unit 24 slides. The second slider unit 24 is disposed around the second tilt shaft 19*b*, but it is not directly controlled by the second tilt shaft 19*b*. As shown in FIG. 5, bottom grooves 55 and top grooves 56 are formed on the bottom and top surfaces of the second slider unit 24, respectively. The bottom grooves 55 are orthogonal to the top grooves 56. The bottom grooves 55 formed on the bottom surface of the second slider unit 24 engage the ribs 53 on the top surface of the first slider unit 23, and the top grooves 56 formed on the top surface of the second slider unit 24 engage ribs 57, which are formed on the top of the slider holder 22 (see FIGS. 2 to 4).

Accordingly, when the tiltable component 19 is tilted in the direction where the first operational-feel providing portions 52 are arranged, both the first slider unit 23 and the second slider unit 24 are moved in the direction where the first operational-feel providing portions 52 are arranged. When the tiltable component 19 is tilted in the direction orthogonal to the direction where the first operational-feel providing portions 52 are arranged, only the first slider unit 23 is moved in the direction orthogonal to the direction where the first operational-feel providing portions 52 are arranged. As a result, the first slider unit 23, the second slider unit 24, and the slider holder 22 engage each other all the time, and therefore, the first slider unit 23 is not rotated about the second tilt shaft 19*b* when the tiltable component 19 is subjected to a tilt operation or a turn operation.

As described above, in this embodiment, the first slider unit 23, the first operational-feel providing portions 52 formed on the first slider unit 23, the second slider unit 24, the driving bars 25, and the first springs 26 constitute the tilt-operation feel providing means.

The rotatable unit 27 includes a rotating cylindrical portion 61 and an annular plate 62. The rotating cylindrical portion 61 has a diameter larger than that of each of the tilt-shaft holder 20 and the slider holder 22, and the top of the cylindrical portion 61 is joined to the turning knob 34 by a snap fit. The annular plate 62 protrudes from the bottom end of the rotating cylindrical portion 61 in a direction at right angles thereto. As shown in FIG. 6, on the bottom surface of the annular portion 62, a second operational-feel providing portion 64 including many small protrusions 63 circumferentially arranged about the rotation center O of the rotatable unit 27 with equal spacing is provided. The annular portion 62 has many light-shielding plates 65 at its periphery such that the light-shielding plates 65 are arranged like the teeth of a comb and extend vertically. The balls 28 and the second springs 29 are arranged in positions opposed to the second operational-feel providing portion 64 in the lower casing 11 at the same spacing as the diameter of the second operational-feel providing portion 64. As a result, when a state in which the joystick switching device is not operated, as shown in FIG. 2, is shifted to a state in which the rotatable unit 27 is rotated about the rotation center O, movements occurring when the balls 28 roll on the small protrusions 63 are conveyed to the turning knob 34 through the rotating cylindrical portion 61, so that the user can have a required operational feel.

As described above, in this embodiment, the rotatable unit 27, the second operational-feel providing portion 64 formed on the rotatable unit 27, the balls 28, and the second springs 29 constitute the turn-operation feel providing means.

As shown in FIG. 7, a light-emitting element 71 and a photoreceptor element 72, which are included in each of the photo-interrupters 30*a* and 30*b*, are arranged on opposite sides of a path for passing the light-shielding plates 65 therebetween.

The upper casing 32 includes a casing cylindrical portion 81 for covering the periphery of the rotatable unit 27 and a plane portion 82 for covering the top surface of the lower casing 11. The upper casing is secured to the lower casing 11 by the screws 33.

The operation of this joystick switching device according to this embodiment will now be described below.

As shown in FIG. 2, when the joystick switching device is not operated, the tiltable component 19 stands perpendicular to the lower casing 11 and the tilt-operation knob 1 is positioned at the top of the joystick switching device relative to the lower casing 11. As a result, pushing force generated by the operation of the tilt-operation knob 1 is not exerted on the rubber contacts 16, and therefore, the tilt-detecting switches do not output a switching signal. In addition, since the rotatable unit 27 is not turned, the photo-interrupters 30*a* and 30*b* do not output a rotation-detecting signal.

From this state, when the tilt-operation knob 1 is tilted in one direction, as shown in FIG. 3, the second tilt shaft 19*b* is then tilted to the tilt direction of the tilt-operation knob 1, and then, the driving legs 19*c* of the tiltable component 19 press one or two of the driving bars 18, which are arranged in the tilt direction of the tiltable component 19. Then, pushing force is exerted on corresponding tilt-detecting-switch rubber contact(s) 16, thus elastically deforming one or two of the tilt-detecting-switch rubber contacts 16 in a selective manner. As a result, the movable contact(s) that are formed on the elastically-deformed tilt-detecting-switch rubber contact(s) 16 and corresponding fixed contact(s) formed on the second wiring board 13 are electrically connected together, and therefore, one or two of the tilt-operation switches output a switching signal. When the tilt-operation knob 1 is tilted in one direction, the first slider unit 23 is then slid in the tilt direction of the tiltable component 19 and the leading edges of the driving bars 25 move on from the central recess 52*a* to one of the outer recesses 52*b*. Movements occurring when the driving bars 25 pass over the projections 52*c* formed in gaps among the central recess 52*a* and the outer recesses 52*b* are conveyed to the tilt-operation knob 1 through the tiltable component 19, so that the user can have a required operational feel. When the tilt-operation knob 1 tilted in one direction is then turned, the leading edges of the driving bars move on from a first outer recess 52*b* to a second outer recess 52*b*. Movements occurring when the driving bars 25 pass over one of the projections 52*c* that is formed in a gap between the first and second outer recesses 52*b* are conveyed to the tilt-operation knob 1 through the tiltable component 19. Therefore, the user can have a required operational feel, as is the case with a tilt operation.

In a state in which the joystick switching device is not operated, when the turning knob 34 is turned, the rotatable unit 27 is then turned in the operational direction and the light-shielding plates 65, which are arranged like the teeth of a comb, cross a space defined between the light-emitting element 71 and the photoreceptor element 72, which constitute the photo-interrupters 30*a* and 30*b*. Therefore, the photo-interrupters 30*a* and 30*b* output a rotation-detecting signal based on a photoreceptor signal of the photoreceptor element 72. When the turning knob 34 is turned, the balls 28 successively roll on the small protrusions 63 of the second operational-feel providing portion 64 formed on the bottom of the rotatable unit 27. The movements occurring during this time are conveyed to the turning knob 34 through the rotatable unit 27, so that the user can have a required operational feel.

In the joystick switching device according to this embodiment, the tilt-operation feel providing means for providing an operational feel, such as tactile feedback, in response to a tilt operation of the tiltable component 19 is disposed around the second tilt shaft 19*b*, i.e., is positioned at the upper part of the second tilt shaft 19*b*. As a result, the distance between the tilt-operation feel providing means and the tilt-operation knob 1 is short, and therefore, the elastic deformation of the tiltable component 19 has little effect. Thus, the tactile feedback supplied from the tilt-operation feel providing means is directly provided to the tilt-operation knob 1, thus achieving a good operational feel of the tilt-operation knob 1 in a tilt direction. This joystick switching device functioning as a controller of an automotive electrical system allows the user to perform various controls for the automotive electrical system readily and reliably without looking at the joystick switching device, and therefore, the operability of the joystick switching device is increased.

In the joystick switching device according to this embodiment, the tilt-operation feel providing means for providing an operational feel, such as tactile feedback, in response to a tilt operation of the tiltable component 19 includes the first operational-feel providing portion 52 formed on the bottom of the first slider unit 23, the driving bars 25 whose leading edges are in contact with the first operational-feel providing portion 52, and the first springs 26 urging the driving bars 25 toward the first slider unit 23. As a result, a change in a state of contact between the first operational-feel providing portion 52 and the driving bars 25, functioning as a mechanical operational feel, is provided to the tilt-operation knob 1. A sharp operational feel that is not realized only by the elastic deformation of the rubber contacts 16 is provided to the user. Even if the rubber contacts 16 are degraded with time, a good operational feel can last a long time.

In the joystick switching device according to this embodiment, the slider includes the first slider unit 23 being slidable by the tiltable component 19 and the second slider unit 24 being slidable in only one direction independently of a tilt direction of the tiltable component 19. As a result, the second slider unit 24 prevents the first slider unit 23 from being rotated by a turn of the tiltable component 19, and therefore, the first operational-feel providing portion 52 formed in the bottom surface of the first slider unit 23 is moved in parallel in a tilt direction of the tiltable component 19 all the time. A required operational feel in accordance with a change in a state of contact between the first operational-feel providing portion 52 and the driving bars 25 can be provided to a user through the operation component 1 serving as both a turn-operation knob and a button with stability.

In the joystick switching device according to this embodiment, the rotatable unit 27 turned by the turning knob 34 is arranged around the tilt-operation feel providing means. The rotatable unit 27 receives a required operational feel from the turn-operation feel providing means including the second operational-feel providing portion 64 formed on the annular portion 62, the balls 28, and the second springs 29, and the state of rotation of the rotatable unit 27 can be detected by the photo-interrupters 30*a* and 30*b* serving as the rotation-detecting means. As a result, an automotive electrical system can be controlled based on both a switching signal output from the tilt-detecting switches and a detection signal from the photo-interrupters 30*a* and 30*b* by the operation of the operation component 1 serving as both a turn-operation knob and a button. Therefore, the joystick switching device can have enhanced performance.

In the joystick switching device according to this embodiment, the turn-operation feel providing means for providing an operational feel, such as tactile feedback, in response to a turn operation of the rotatable unit 27 includes the second operational-feel providing portion 64 formed on the bottom surface of the rotatable unit 27, the balls 28 in contact with the second operational-feel providing portion 64, and the second springs 29 urging the balls 28 toward the rotatable unit 27. As a result, a change in a state of contact between the second operational-feel providing portion 64 and the balls 28, functioning as a mechanical operational feel, is provided to the turning knob 34. A sharp operational feel is thus provided to a user, so that the operability of the joystick switching device is increased and a good operational feel can last a long time.

In the joystick switching device according to this embodiment, the rotation-detecting means for detecting a state of rotation of the rotatable unit 27 includes the light-shielding plates 65 formed on the rotatable unit 27, the light-emitting element 71, and the photoreceptor element 72, an optical path between both elements being interrupted by the light-shielding plates 65. Compared with when a magnetic sensing element or light-reflecting detecting means is used, the rotatable unit 27 has a simpler structure. As a result, the joystick switching device is available at low cost.

What is claimed is:

1. A joystick switching device comprising:

a casing;

tilt-detecting means disposed in the casing;

a tiltable component having a tilt shaft capable of being subjected to a tilt operation and a driving leg for driving the tilt shaft and the tilt-detecting means, the tiltable component being held on the casing, and the driving leg being joined to the tilt shaft;

a tilt-operation knob that cooperates with the tilt shaft; and tilt-operation feel providing means for providing tactile feedback to a user in response to a tilt operation of the tilt shaft, the tilt-operation feel providing means being arranged around the tilt shaft so as to cooperate with the tilt shaft of the tiltable component, wherein the tilt-operation feel providing means comprises:

a tilt-shaft holder including a through-hole through which the tilt shaft passes and being fixed to the casing;

a slider holder including a through-hole through which the tilt shaft passes and being mounted on the tilt-shaft holder with a space therebetween;

a slider disposed in the space defined between the tilt-shaft holder and the slider holder, the slider having a central hole that the periphery of the tilt shaft contacts, the slider being slidable in accordance with a tilt operation of the tilt shaft inside the space;

a first operational-feel providing portion which is a recessed portion formed on a bottom surface of the slider including a central recess, outer recesses, and projections formed in gaps among the central recess and the outer recesses;

a driving bar being movable reciprocally through the top of the tilt-shaft holder, a leading edge of the driving bar being in contact with the recessed portion of the first operational-feel providing portion; and a first spring urging the driving bar toward the recessed portion formed on the slider.

2. The joystick switching device according to claim 1, wherein the slider comprises:

a first slider unit having the first operational-feel providing portion formed in a bottom surface of the first slider unit and being slidable by the tilt shaft in a tilt direction of the tilt shaft; and a second slider unit engaging with the first slider unit so as to be slidable in only one direction independently of the tilt direction of the tilt shaft.

3. The joystick switching device according to claim 1, further comprising:

a rotatable unit disposed around the tilt-operation feel providing means;

a turning knob mounted on an upper end of the rotatable unit;

turn-operation feel providing means for providing a required operational feel to the user in response to a turn operation of the turning knob; and rotation-detecting means for detecting a state of rotation of the rotatable unit.

4. The joystick switching device according to claim 3, wherein the turn-operation feel providing means comprises:

a second operational-feel providing portion arranged circumferentially about a rotation center of the rotatable unit on a bottom surface of the rotatable unit;

a ball being movable in the casing and being in contact with the second operational-feel providing portion; and a second spring urging the ball toward the rotatable unit.

5. The joystick switching device according to claim 3, wherein the rotation-detecting means comprises:

light-shielding plates arranged like teeth of a comb and disposed circumferentially about a rotation center of the rotatable unit;

a light-emitting element; and a photoreceptor element, wherein the light-emitting element and the photoreceptor element are arranged on opposite sides of a path for passing the light-shielding plates therebetween.

* * * * *

UNITED STATES PATENT AND TRADEMARK OFFICE

CERTIFICATE OF CORRECTION

PATENT NO. : 7,492,353 B2
APPLICATION NO. : 10/963096
DATED : February 17, 2009
INVENTOR(S) : Ushimaru et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1163 days.

Signed and Sealed this
Twenty-ninth Day of March, 2011

David J. Kappos

David J. Kappos
*Director of the United States Patent and Trademark Office*